United States Patent [19]

Choate

[11] Patent Number: 4,742,439

[45] Date of Patent: May 3, 1988

[54] DESKTOP KINETIC DISPLAY DEVICE

[76] Inventor: Albert G. Choate, 348 Honeoye Falls, #6 R.D., Honeoye Falls, N.Y. 14472

[21] Appl. No.: 52,372

[22] Filed: May 21, 1987

[51] Int. Cl.[4] ..... F21V 3/00; F21V 21/30; F21V 5/00

[52] U.S. Cl. ..... 362/311; 362/35; 362/318; 362/806; 362/811; 353/1; 353/2

[58] Field of Search ..... 362/35, 18, 101, 125, 362/277, 307, 311, 318, 355, 806, 811, 457, 458; 350/4.1, 4.2, 352, 371, 373; 353/1, 2, 20

[56] References Cited

U.S. PATENT DOCUMENTS

| | | | |
|---|---|---|---|
| 3,255,661 | 1/1966 | Marban | 353/1 X |
| 3,358,556 | 12/1967 | Brown | 353/2 |
| 3,843,244 | 10/1974 | Facchini | 353/2 |
| 3,885,865 | 5/1975 | Stern et al. | 362/35 X |
| 4,107,764 | 8/1978 | Riley | 362/35 |
| 4,653,843 | 3/1987 | Karelitz | 353/2 X |

*Primary Examiner*—Larry Jones

*Attorney, Agent, or Firm*—Shlesinger Fitzsimmons Shlesinger

[57] ABSTRACT

The housing of this device contains an electric lamp and an electric motor, the drive shaft of which rotates a circular, light transmissive, polarized cell, which is removably mounted in the housing over a light transmissive plate, which is mounted in an opening in the housing to direct diffused light from the lamp onto one side of the cell. The cell has a chamber filled with a liquid, and a plurality of small, birefringent elements which float randomly in all directions as the cell rotates, and which disperse light from the lamp into a variety of constantly changing colors and hues that are visible from the side of the cell remote from the diffuser.

10 Claims, 1 Drawing Sheet

DESKTOP KINETIC DISPLAY DEVICE

BACKGROUND OF THE INVENTION

This invention relates to a desktop device which utilizes a light source and a rotating polarized cell to produce a kinetic sculptural effect in the form of a variety of striking and changing colors. More specifically, this invention relates to an illuminated polarized cell containing a plurality of pieces of birefringent materials which float in a liquid medium, and which provide striking color variations when the cell is rotated.

There are available in the marketplace a number of kinetic light display devices which produce striking color variations when operated. A conventional kaleidoscope, for example, provides continually changing patterns of color, when the barrel of the device is rotated. Typically a device of this type contains a plurality of bits of colored glass and mirrors, which produce continually changing color patterns when rotated. Such devices have the disadvantage that the patterns that are produced are rather limited, and they usually require sunlight (white light) as a light source.

It is an object of this invention to provide an improved kinetic light display device of a sculptural nature, which is relatively simple and inexpensive to manufacture, and which provides startling color changes and patterns during use.

A more specific object of this invention is to provide a novel desktop device having a rotatable, replacable polarized cell which, upon being illuminated, is disposed to project a variety of colors and shades which are constantly changing as the cell rotates.

Still another object of this invention is to provide a desktop device of the type described which is capable of producing a variety of changing colors which can be projected, if desired, through an imaging lens onto a remote screen or the like.

Other objects of the invention will be apparent hereinafter from the specification and from the recital of the appended claims, particularly when read in conjunction with the accompanying drawings.

SUMMARY OF THE INVENTION

A hollow, transparent, disk-shaped cell contains a liquid and a plurality of birefringent chips, which are free to float in all directions in the liquid. the cell has thin, polarized sheets of material secured over the opposed faces thereof, and is mounted in a housing to rotate in coplanar, confronting relation to a disk-shaped diffuser. The diffuser is mounted in the housing over an opening, and in registry with a lamp bulb, which projects diffused light through the cell. A motor in the housing has a drive shaft frictionally engaged with the periphery of the cell to rotate the latter when the motor is energized.

As the cell rotates, its birefringent chips are free to rise and fall and twist and turn in the liquid medium in which they float, thus causing the light from the lamp bulb to be refracted constantly into varying colors and shades.

THE DRAWINGS

PREFERRED EMBODIMENTS OF THE INVENTION

Figure 1:
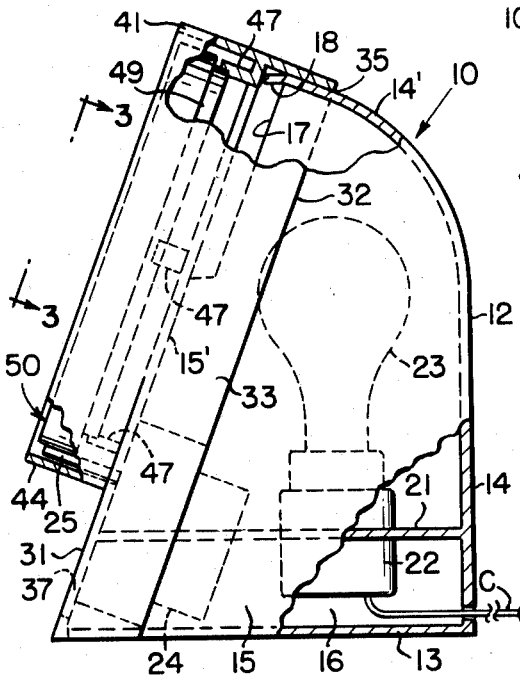
FIG. 1 is a fragmentary side elevation view of a desktop device made according to one embodiment of this invention, portions of the device being cut away and shown in section.
Figure 3:
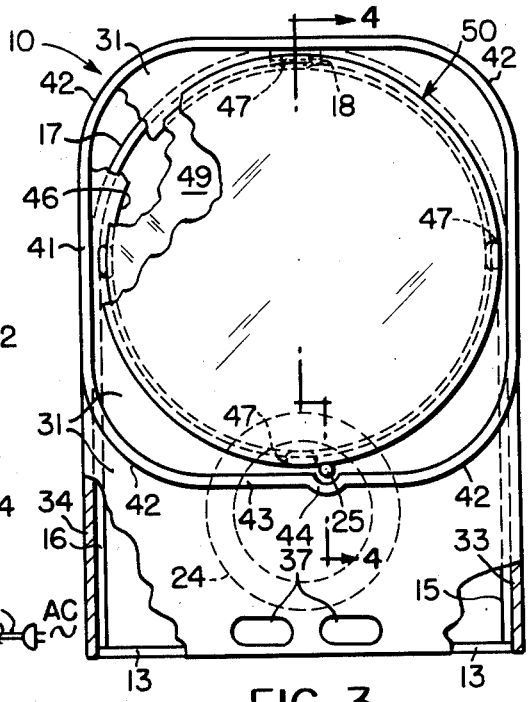
FIG. 3 is a front elevational view of this device, with portions thereof cut away for purposes of illustration.
Figure 2:
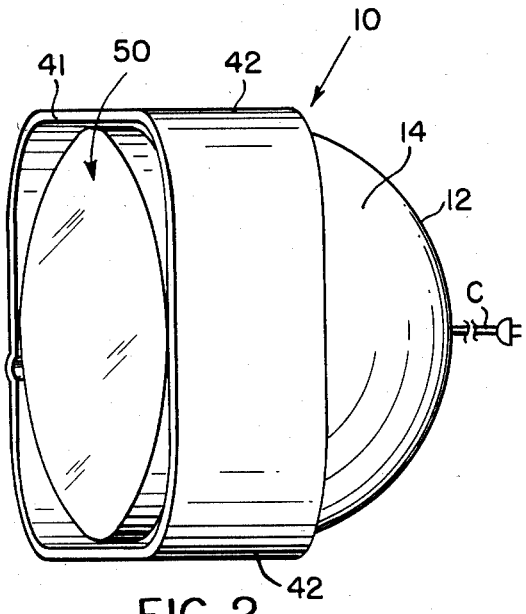
FIG. 2 is a plan view of this device.

Referring now to the drawings by numerals of reference, and first to FIGS. 1 to 3, 10 denotes generally a desktop device comprising a housing 12 having a plane, flat bottom wall 13, which is generally U-shaped in configuration when viewed in plan. Integral with the marginal edge of the bottom wall 13, and projecting upwardly therefrom is an integral, curved rear wall 14 having a lower portion that is also U-shaped or semi-circular in cross section, and an upper portion 14′ which overlies wall 13 and is segmental spherical in configuration. Rear wall 14 has spaced, parallel legs which form sidewalls 15 and 16, and which are integral at their lower edges with the opposed side edges of the bottom wall 13. As shown more clearly in FIG. 1, the forward edges of the sidewalls 15 and 16 are in registry with each other and are inclined slightly rearwardly. Moreover, adjacent their upper ends these edges are provided with elongate notches or recesses 17, at opposides of a rectangular lug or tab 18, that projects from the forward edge of the section 14′ centrally thereof for a purpose noted hereinafter.

Adjacent its lower end housing 12 has therein an integral, transverse partition wall 21, which is positioned above and in spaced, parallel relation to the bottom wall 13. Secured in the partition 21 adjacent the rear housing wall 14 with its receptacle facing upwardly is a conventional lamp socket 22, in which is removably mounted a conventional lamp or bulb 23. Also mounted in the partition 21 forwardly of the lamp socket 22 is an electric motor 24. This motor has projecting from its forward or left end as shown in FIG. 1 a rotatable operating shaft 25, which extends out of the housing 12 beyond the inclined forward edges of its sidewalls 15 and 16.

The open, front end of housing 12 (the left end in FIG. 1) is sealed or closed by a generally, rectangularly shaped cover plate 31 having an integral, rearwardly projecting apron or flange 32 (FIG. 1), which includes spaced, parallel side sections 33 and 34 (FIG. 3) that seat in overlapping relation over the forward edges of the housing side walls 15 and 16, respectively. Flange 32 also has a straight or flat upper section which, as shown at 35 in FIG. 1, overlies and has tangential engagement with the forward, marginal edge of the housing section 14. Also as shown in FIG. 1, the tab 18 on the forward, upper edge of housing 14 engages the underside of the coverplate 31 to limit the extent to which the upper end of the plate 31 can be inserted over the housing 14. And adjacent its lower edge the cover plate 31 has therein a pair of spaced vent openings 37 for permitting cooling air to enter the housing 14 adjacent the motor 24.

Plate 31 also has on its upper portion an integral, generally rectangularly shaped flange or skirt 41, which projects laterally outwardly from the face of the plate in the direction opposite to that of the flange 32. Flange or skirt 41 has rounded corners 42 the two uppermost of which register with like rounded corners formed on the rearwardly projecting flange 32. However, the lower leg or section 43 of flange 41 extends transversely across the face of plate 31 adjacent the motor 24, and has intermediate its ends a recessed section 44 which passes beneath and registers with the motor shaft 25.

Figure 4:
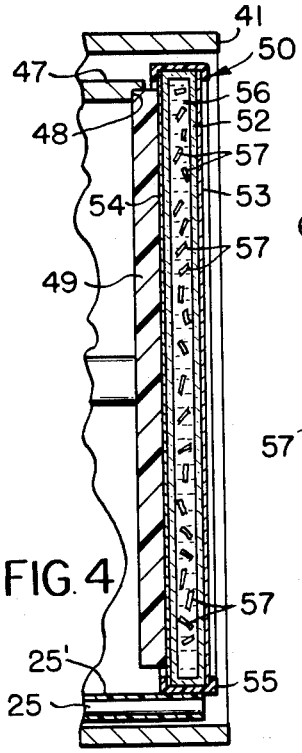
FIG. 4 is an enlarged fragmentary sectional view taken generally along the line 4—4 in FIG. 3 looking in the direction of the arrows.

Plate 31 has in its upper end a large, circular opening 46, which is positioned concentrically within the flange 41. Integral with plate 31 and projecting laterally upwardly therefrom at the edge of opening 46, and at 90° intervals about its axis, are four, diffuser supporting fingers 47, each of which has in its outer end a notch 48 (FIG. 4). Seated adjacent its periphery in the notches 48 of the four fingers 47 to be secured thereby coaxially over the opening 46 is a circular diffuser disk 49, which can be made of a plastic or glass material frosted or otherwise treated to function as a light diffuser. Removably seated in the opening formed by the skirt 41 to rest against the outer face of the diffuser disk 49 is a polarized cell, which is denoted generally by the numeral 50. Cell 50, as noted hereinafter is disposed to be rotated by the shaft 25 while resting against the face of the diffuser plate 49.

Referring now to FIG. 4, cell 50 comprises a hollow, transparent, disk-shaped container 52 having secured coaxially over the opposed faces thereof disk-shaped polarizing filters 53 and 54, respectively. Container 52 and its attached filters 53 and 54 are enclosed in an annular, resilient sleeve 55, which is drivingly and tangentially engaged with a correspondingly resilient sleeve 25' that is secured to and surrounds the outer end of the drive shaft 25. In this way, when shaft 25 is rotated, the entire cell 50 is caused to be rotated about its axis by virtue of the frictional engagement between the sleeves 55 and 25'.

The transparent disk 52 contains a liquid 56, and a plurality of separate, birefringent chips 57, which are allowed freely to float in the liquid 56 as the cell 50 is rotated.

In use, the lamp 23 is energized in a conventional manner by a wire or cord C which projects out of an opening in the bottom of the housing wall 14 for connection to an AC power supply. By means which form no part of this invention, the motor 24 is also adapted to be energized at this time in any conventional manner, thereby to cause the cell 50 slowly to be rotated relative to the face of the now-illuminated diffuser plate 49. Consequently, one observing the rotating cell 50 through the opening in the front of the flange or skirt 41 will be able to observe the chips 57 as they float randomly in the fluid 56. As the cell 50 rotates, the chips 57 will tend to drift downwardly and perhaps laterally as they are repeatedly rotated above and below the axis of the rotating cell 50. The light from the diffuser 49 therefore causes the chips 57 to project to the eye of the observer a kinetic form of sculpture in which the colors and shapes thereof are forever changing.

Figure 5:
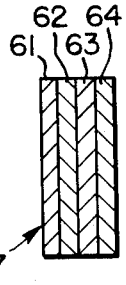
FIG. 5 is a greatly enlarged sectional view through one of the chips that is mounted to float in the cell shown in FIG. 4.

For example, the two polarizing filters 53 and 54 are applied to the disk 52 to provide cross or intersecting polarized fields upon which transparent regions of varying colors are created by the birefringent chips 57. As shown for example in FIG. 5, each chip may comprise, simply, four different pieces 61–64 of scotch tape, which are secured one over the other to produce, in effect, a birefringent filter of at least one wave length at certain times during the passage of the associated chip 57 downwardly or laterally in the liquid 56 as cell 50 rotates. By producing the chips 57 from light materials, typically plastics, the chips will tend to float or sink (or both) in the liquid bath, depending upon their respective weights, and the rate at which the cell 50 rotates. As a consequence, they create an interesting and ever-changing pattern when the cell is rotated, and as they cascade in the liquid 56.

One of the advantages of the device as disclosed herein is that the cell 50, and for that matter the diffusion disk 49, can be readily removed and replaced if desired, simply by grasping the outer peripheral surfaces of the elements 50 and 49 in the spaces produced adjacent the rounded corners 42 of the flange 41. Also, by including the elongated notches 17 in the forward edge of the housing section 14', cooling air is free to circulate into and out of the housing, for example by entering at the rounded corners 42 of the flange 41, beneath the adjacent edges of the cell 50 and disk 49, and through the elongated notches 17 into the vicinity of the bulb 23 This permits dissipation from the housing of any heat that might be developed because of the operation of the bulb 23 and the motor 24. As noted above, the vent holes 37 in the front wall 31 of the housing also serve to cool the interior of the housing.

The light diffusing disk 49 may be, by way of example, the type sold by Rowland Development Corp. under the designation "ROWLUX" C-2-1-001. It has an embossed pattern of minute lenticular elements so that when a similar "ROWLUX" diffuser (not illustrated) is also attached to the contacting face of the rotating cell 50, an additional pulsating Moire' pattern effect is superimposed or viewed through the chomatic transparent regions created by the chips.

The liquid bath or fluid 56 may be water, or preferably, a mixture of water and an additive such as ethylene glycol or the like, to alter the viscosity and/or density of the bath. The density of the liquid preferably should fall somewhere between the densities of the plastic materials used to produce the chips 57, for example somewhere in the range of 0.9–1.3 relative to water. Also, a small amount of a detergent, when added to the fluid, will prevent the undesirable formation of air bubbles on the chips 57.

From the foregoing it will be apparent that the present invention provides a relatively simple and inexpensive means for producing by light dispersion a kinetic sculptural effect readily observable when the device 10 is mounted on a desktop, or the like, and the cell 50 is illuminated from behind, and rotated. The cell 50, which is readily removable, may of course be made in a variety of shapes and sizes, and may contain respectively different types and sizes of birefringent elements to produce different lighting effects. Also, as noted above, it may have secured to the side thereof facing diffuser 49 a similar, thin layer of diffuser material for generating a Moire' effect.

Although this invention has been illustrated and described in detail in connection with only certain embodiments thereof, it will be apparent that it is capable of still further modification, and that this application is intended to cover any such modifications that may fall within the scope of one skilled in the art, or the appended claims.

I claim:

1. A device for producing a continually changing display of colors, comprising a source of light, a light transmissive cell, means mounting said cell for rotation adjacent said light, and with one side of said cell confronting said source of light to be illuminated thereby, and a translucent diffuser interposed between said source and said cell to diffuse light directed from said source to said one side of said cell, said cell having therein chamber containing a liquid comprising water, and a plurality of light transmissive birefringent elements mounted in said chamber to move randomly in said liquid upon rotation of said cell, said water including an additive operative to prevent formation of air bubbles on said birefringent elements.

2. A desktop device for producing moving, kinetic sculptural lighting effects, comprising a housing having therein a chamber containing a removable light source, a diffuser plate positioned over on opening in said housing to be illuminated by said light source, a light transmissive cell comprising a transparent container having opposed sidewalls each of which has secured thereon one of two different polarizing filters, said cell being removably mounted in said housing with one side thereof positioned adjacent to and confronting upon said diffuser plate to be illuminated by light passing through said plate from said source, and with the opposite side of said cell facing outwardly of said housing to be visible from the exterior thereof, said cell having therein a chamber containing a liquid, and a plurality of generally small, birefringent elements disposed in said liquid to move randomly therein upon movement of the cell, and means in said housing drivingly connected to said cell and operable to effect rotation of said cell about an axis extending transversely of said sides of the cell, said polarizing filters having their polar axes positioned to provide on opposite sides of said cell intersecting polarized fields which remain fixed relative to one another upon rotation of said cell.

3. A desktop device as defined in claim 2, wherein said means comprises an electric motor mounted in said housing and having a drive shaft extending parallel to the axis of said opening in said housing, and, said cell is circular in configuration and has its outer peripheral surface removably and drivingly engage with said shaft.

4. A desktop device as defined in claim 3, wherein said housing has a flat bottom wall disposed to be seated on a desktop, and an inclined front wall containing said opening and disposed releasably to support said diffuser plate over said opening, and in a plane inclined to said housing bottom wall, and said cell is removably mounted over said plate to rotate relative thereto, and with said one side thereof disposed in coplanar, sliding engagement with the confronting side of said diffuser plate.

5. A polarized cell for producing kinetic sulptural lighting effects when moved while light is passing therethrough, comprising a transparent container having a pair of opposed, planar sidewalls, a liquid substantially filling said container, a plurality of rather small, light transmissive, birefringent elements in said liquid, and disposed to float randomly in all directions in the liquid as the container is moved, and a pair of polarizing filters each of which is secured on a different one of the opposed sidewalls of said container with their polar axes positioned to provide intersecting polarized fields on said sidewalls.

6. A polarized cell as defined in claim 5, wherein each of at least certain of said elements comprises a plurality of thin layers of plastic material secured one over the other with adjacent layers disposed in coplanar relation.

7. A polarized cell as defined in claim 6, wherein said liquid comprises a mixture of water and a liquid additive, the mean density of said mixture falling within the range of 0.9–1.3 relative to water.

8. A polarized cell as defined in claim 5, including light diffuser means secured over one of the sidewalls of said container.

9. A polarized cell as defined in claim 8, wherein said light diffuser means is operative to produce a Moire' pattern effect, when moved relative to a stationary, like diffuser means, and light is observed after passing through said diffuser means and said cell.

10. A polarized cell for producing lighting effects, comprising a transparent container having opposed sidewalls, a liquid substantially filling said container, a plurality of rather small, light transmissive, birefringent elements in said liquid, and disposed to float randomly in all directions in the liquid as the container is moved, and means polarizing each of the opposed sidewalls of said container, said liquid further including an additive operative to prevent the formation of air bubbles on said elements.

* * * * *